United States Patent [19]

Lemahieu et al.

[11] Patent Number: 4,514,494

[45] Date of Patent: Apr. 30, 1985

[54] PHOTOGRAPHIC COLOR MATERIAL INCORPORATING DEVELOPING AGENTS FOR COLOR DEVELOPMENT

[75] Inventors: Raymond G. Lemahieu, Mortsel; Wilhelmus Janssens, Aarschot, both of Belgium

[73] Assignee: Agfa-Gevaert N.V., Mortsel, Belgium

[21] Appl. No.: 548,784

[22] Filed: Nov. 4, 1983

[30] Foreign Application Priority Data

Nov. 12, 1982 [GB] United Kingdom ..... 8232449

[51] Int. Cl.[3] ..... G03C 7/40; G03C 7/16; G03C 1/02

[52] U.S. Cl. ..... 430/376; 430/364; 430/380; 430/565; 430/566; 430/966

[58] Field of Search ..... 430/380, 364, 565, 566, 430/376, 966, 967

[56] References Cited

U.S. PATENT DOCUMENTS

| | | | |
|---|---|---|---|
| 3,245,787 | 4/1966 | Willems et al. | 430/361 |
| 3,265,502 | 8/1966 | Willems et al. | 430/439 |
| 3,293,032 | 12/1966 | Jaeken et al. | 430/378 |
| 3,730,716 | 5/1973 | Land et al. | 430/566 |
| 4,004,926 | 1/1977 | Willems et al. | 430/379 |

*Primary Examiner*—Mary E. Downey
*Attorney, Agent, or Firm*—William J. Daniel

[57] ABSTRACT

A photographic material suited for the production of (an) azine dye image(s), and having at least one silver halide emulsion layer and/or a separate layer in water-permeable relationship with such an emulsion layer which contains:

(1) a heterocyclic hydrazone compound, (2) a phenol, naphthol or active methylene coupler compound capable of forming on oxidative coupling with compound (1) an azine dye, (3) an electron transfer agent or ETA-compound capable of forming a positively charged semiquinone on oxidation with exposed silver halide, (4) a reducing agent capable of reducing the thus-formed semiquinone in acidic medium, and having in the pH range of 2–5, a polarographic half-wave potential ($E\ \frac{1}{2}$) which is at least 40 mV more negative (according to the European Convention) than the polarographic half-wave potential of the ETA-compound in the same pH range, said material being suited for processing with a simple aqueous alkaline liquid, and (5) an acidic medium.

13 Claims, 2 Drawing Figures

Figure 1:
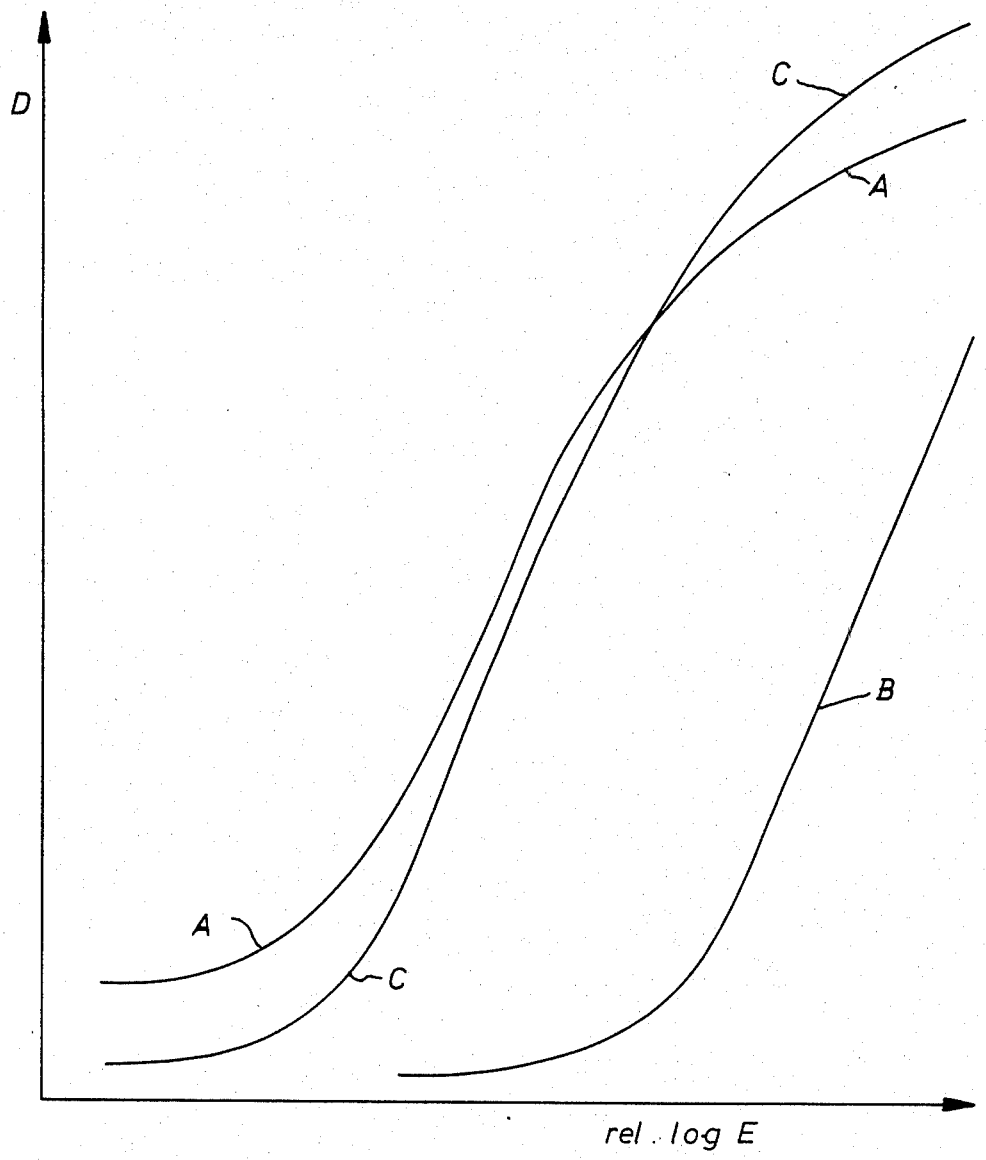

PHOTOGRAPHIC COLOR MATERIAL INCORPORATING DEVELOPING AGENTS FOR COLOR DEVELOPMENT

This invention relates to a photographic colour material incorporating developing agents, and colour development processes using such material.

As is known, the property of certain organic compounds to form a dye during the development of photo-exposed silver halide by coupling with a proper oxidized developing substance is the basis for the classical photographic dye image formation.

According to the classical technique quinone imine dyes and azomethine dyes are formed by coupling of the usual colourless couplers of the phenol, naphthol or ketomethylene type with an oxidized aromatic primary amino developing substance e.g. a primary amino p-phenylene diamine derivative. These couplers may be dissolved in the developer liquid, dispersed in oily globules in the silver halide-gelatin emulsion or directly incorporated in the emulsion when provided with a ballasting group possibly together with a group improving solubility in alkaline medium.

It is commonly known to incorporate developing agents in the photographic silver halide material. The necessary developing conditions are formed by moistening the imagewise exposed photographic material with an activator liquid being a purely alkaline solution.

The incorporation of a developing agent in the silver halide emulsion material poses the risk of fog production, staining and matting of the material by crystallization of the developing agent so that only a rather limited group of developing agents in a restricted amount comes into consideration for incorporation in the photographic material without deleterious effects on the sensitometric properties thereof. Hydroquinone type developers optionally in admixture with secondary developing agents being a 1-phenyl-3-pyrazolidinone or p-(N-monomethyl)aminophenol sulphate compound are suitable for that purpose.

However, these developing agents are of the non-coupling type and excluded from the formation of quinone imine or azomethine dyes. On the other hand the primary amino p-phenylene diamine developing agents used in the formation of dye images are very sensitive to aerial oxidation and strongly stain the photographic material when incorporated therein so that they are not suitable for this purpose.

Further it is known that azomethine dyes are not particularly stable and therefore other photographic dye-forming systems for producing dye images with improved stability have been proposed.

A dye forming system based on the formation of particularly stable azine dyes has been described in the United Kingdom Patent Specification No. 1,498,954. In this patent a method is described of producing a coloured image by developing a latent silver image with a particular p-phenylene diamine applied from an aqueous alkaline solution as defined hereinafter in the presence of (1) a particular heterocyclic hydrazone compound and
(2) a colour coupler of the phenol, naphthol, or active methylene compound series.

Likewise in this colour forming system, a development process operating with an aqueous alkaline liquid including the reductor for the exposed silver halide is as far as processing speed is concerned inferior to a development process wherein already from the beginning of the processing the developing agent(s) at full strength are incorporated in the photographic material and are activated by a simple aqueous alkaline liquid which is inert to aerial oxidation.

There is however again a problem to find developing agents or combinations thereof that have no deleterious effects on the sensitometric properties of the photographic material during its preparation, storage under atmospheric conditions and/or processing.

The p-phenylene diamine developing agents of the type used in GB-P No. 1,498,954 are sensitive to aerial oxidation and stain the photographic material.

Particularly the N,N,N',N'-tetra-alkyl substituted p-phenylene diamine type compounds form coloured salts known as Wurster's salts being semiquinones (also called radical quinones) having a positive charge as described e.g. by J. F. Willems and G. F. van Veelen in Phot. Sci. Eng. Vol. 6, No. 1, January-February 1962 p.40.

It has been experimentally established by us that these Wurster's salts and other positively charged semiquinone radical compounds as described e.g. by J. F. Willems and G. F. van Veelen in Phot.Sci.Eng. Vol.6, No. 1 January-February 1962 p.49 act as desensitizers by destroying the latent image and more particularly reduce the maximum density in the exposed parts of a silver halide emulsion layer containing silver bromide.

It is an object of the present invention to provide a photographic colour material incorporating a photosensitive silver halide emulsion in association with developing and antioxidant substances that on treatment with an aqueous alkaline activator liquid free from developing agents form an azine dye in the presence of photoexposed silver halide. While the invention may be applied to photographic material capable of providing multicolour images, it is particularly suitable to monochrome colour radiographic emulsions whereby economies of silver in the emulsions may be effected due to the fact that the image is built up with silver and dye.

According to the present invention a photographic material suited for the production of (an) azine dye image(s) is provided, wherein at least one silver halide emulsion layer and/or a non-light-sensitive hydrophilic colloid layer in water-permeable relationship therewith contains:

(1) a heterocyclic hydrazone compound,
(2) a phenol, naphthol or active methylene coupler compound capable of forming on oxidative coupling with compound (1) an azine dye, and
(3) a developing agent which is an electron transfer agent (ETA-compound) capable of forming a positively charged semiquinone on oxidation with exposed silver halide, characterized in that the material also contains in acidic medium
(4) an antioxidant capable of reducing the semiquinone in acid medium, and having in the pH range of 2–5 a polarographic half-wave potential ($E\ \frac{1}{2}$) which is at least 40 mV more negative (according to the European Convention) than the polarographic half-wave potential of the ETA-compound in the same pH range, the photographic material having an acidity defined according to a test A described hereinafter corresponding with a pH lower than 7, preferably in the pH range of 2 to 5.

Test A

A strip of the photographic material having a surface area of 1 sq.dm is put for 30 minutes in 100 ml of distilled water whereupon the pH of the liquid extract is measured and has to be below 7 for the present photographic material.

Figure 2:
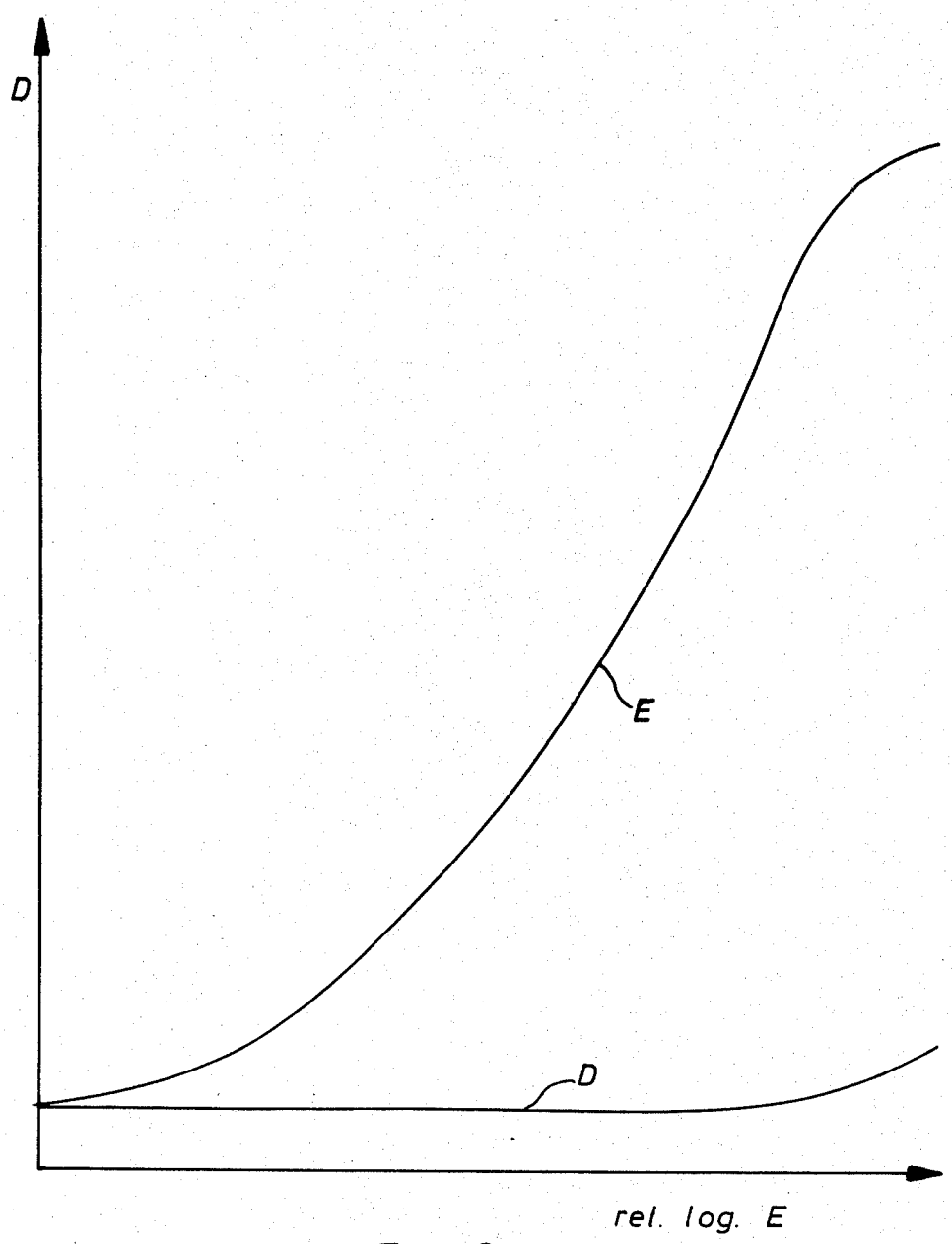

In the accompanying FIGS. 1 and 2 comparative sensitometric curves are provided illustrating the improvement obtained with a photographic material according to the present invention.

The reaction mechanism for the formation of the azine dyes in the same as described in the already mentioned GB-Patent Specification No. 1,498,954 corresponding to U.S. Pat. No. 4,004,926.

Hydrazone compounds (1) that are suitable for use in the present photographic material correspond to the following general formula:

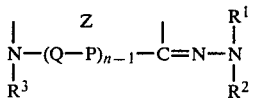

wherein:

n is 1, 2, or 3, $R^1$ is hydrogen or an acyl group e.g. acetyl, $R^2$ is a $—CONH_2$ group or a $—SO_2X$ group, wherein X represents a hydroxyl group, an amino group, a hydrocarbon group, e.g. an alkyl group, an acyl group or a heterocyclic group including said groups in substituted form, $R^3$ is an alkyl group or an aryl group e.g. a methyl group, P and Q (same or different) represent a methine group or a substituted methine group e.g. an alkyl or aryl substituted methine group, and Z represents the necessary atoms to close a nitrogen-containing heterocyclic nucleus including said nucleus in substituted form e.g. substituted with alkyl or a sulpho group.

Hydrazone compounds that are particularly suitable for use according to the present invention correspond to one of the following general formulae:

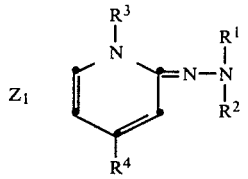

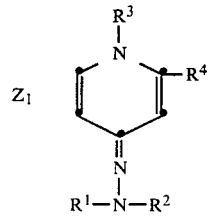

wherein:

$R^1$ is hydrogen or an acyl group e.g. acetyl, $R^2$ is a $—CONH_2$ group or a $—SO_2X$ group, wherein X represents a hydroxyl group, an amino group, an aliphatic hydrocarbon group, an aryl group, or a heterocyclic group including said groups in substituted form e.g. substituted with carboxyl or sulpho, $R^3$ is an alkyl group e.g. methyl or an aryl group e.g. phenyl;

$R^4$ is an alkyl group e.g. $C_1$–$C_{18}$ alkyl or an aryl group e.g. phenyl, and $Z^1$ represents the atoms necessary to complete a benzene nucleus including a substituted and further condensed benzene nucleus.

The preparation of hydrazone compounds suited for use according to the present invention is described e.g. in the U.S. Pat. Nos. 3,245,787, 3,293,032, 3,525,614 and 3,622,327 and in the United Kingdom Patent Specification No. 993,749 and in the published German Patent Application No. 22 14 381.

Preferred hydrazone compounds are listed in Table 1.

TABLE 1

1.

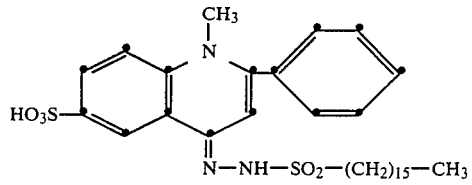

2.

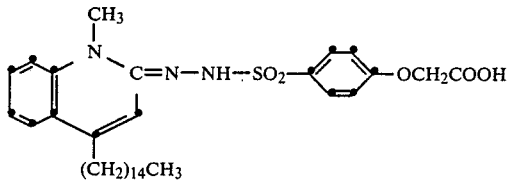

Colour couplers that according to the present invention can form a mainly blue dye are phenol couplers corresponding to the following general formula:

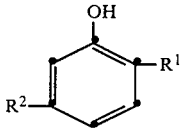

each of $R^1$ and $R^2$ represents hydrogen, an alkyl group including a substituted alkyl group, an alkoxy group including a substituted alkoxy group, or the group —NHR in which R represents a carboxylic acid acyl or sulphonic acid acyl group including said groups in substituted state, e.g. an aliphatic carboxylic acid acyl group, an aromatic carboxylic acid acyl group, an heterocyclic carboxylic acid acyl group e.g. a 2-furoyl group or a 2-thienoyl group, an aliphatic sulphonic acid acyl group, an aromatic sulphonic acid acyl group, a sulphonyl thienyl group, an aryloxy-substituted aliphatic carboxylic acid acyl group, a phenylcarbamoyl aliphatic carboxylic acid acyl group or a tolyl carboxylic acid acyl group, with the proviso that $R^1$ and $R^2$ do not represent hydrogen at the same time.

For such type of phenol colour couplers and their preparation reference is made to U.S. Pat. Nos. 2,772,162 and 3,222,176, and to United Kingdom Patent Specification No. 975,773.

Representatives being within the scope of that general formula are listed in Table 2.

TABLE 2
1.
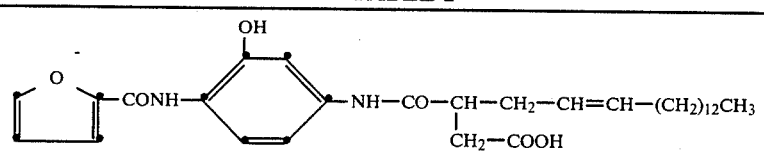
2.
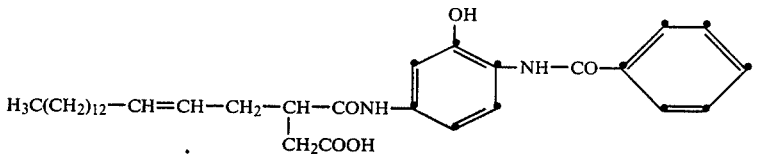
3.
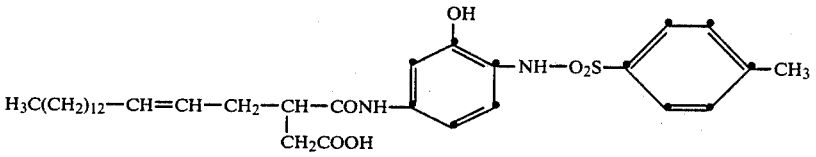
4.
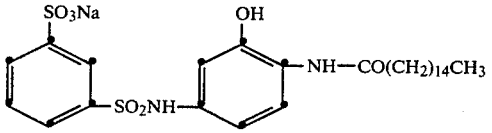
5.
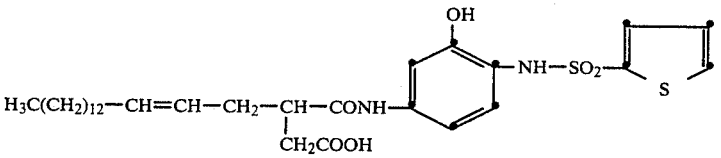
6.
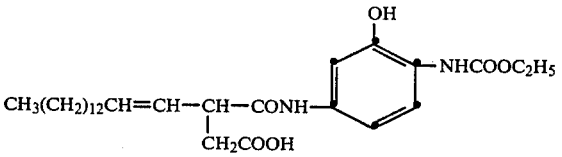
7.
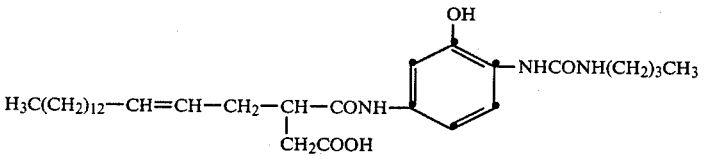
8.
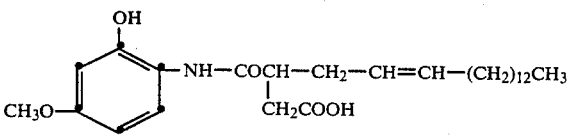
9.
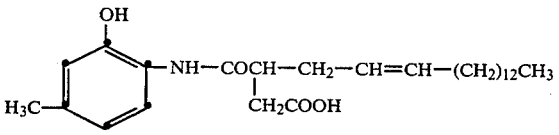
10.
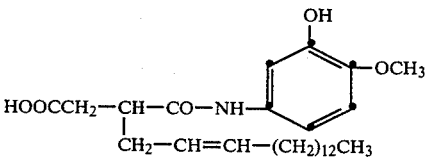

TABLE 2-continued

11.

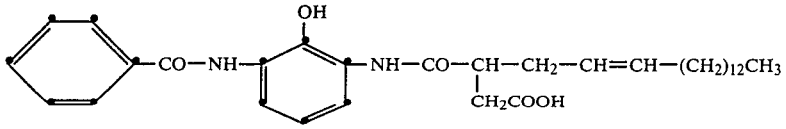

12.

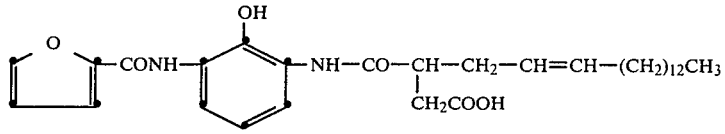

Other useful couplers of the phenol series are polymeric (latex) couplers described in the United Kingdom Patent Specification No. 1,363,230.

Useful couplers of the naphthol series are α-naphthol type couplers corresponding to the following general formula:

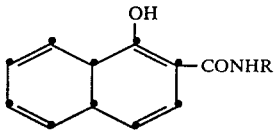

wherein:

R represents an alkyl group including a substituted alkyl group, an aryl group including a substituted aryl group preferably such groups that are substituted with a carboxylic acid or sulphonic acid group.

These α-naphthol type couplers are prepared, e.g., by a condensation reaction using the phenyl ester of 1-hydroxy-2-naphthoic acid and the proper amine and as described e.g. in U.S. Pat. No. 4,178,183.

Examples of said α-naphthol couplers are listed in the following Table 3.

TABLE 3

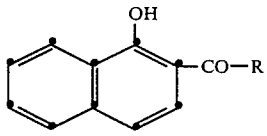

R:

1.

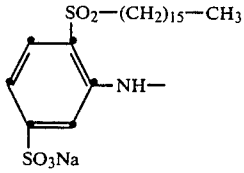

2.

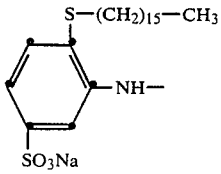

3.

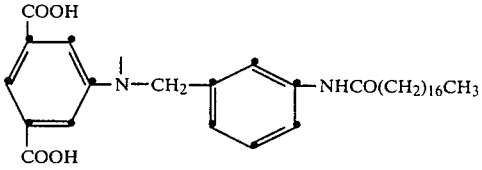

TABLE 3-continued

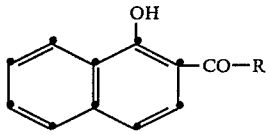

R:

4.

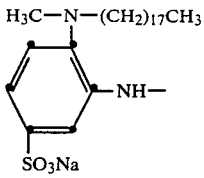

5.

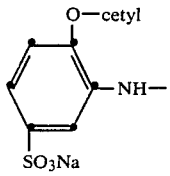

6.

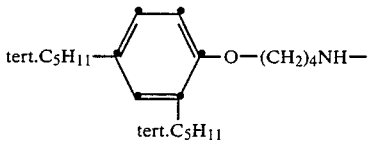

7.

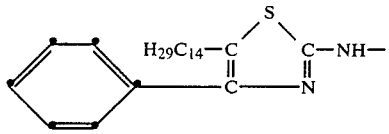

A particularly useful α-naphthol latex-colour coupler for cyan corresponds to the following structural formula:

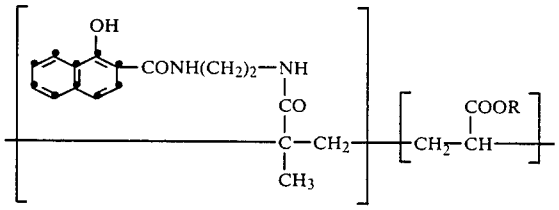

wherein: R represents a lower ($C_1$–$C_4$) alkyl group e.g. methyl, ethyl or n-butyl.

Non-ring closed ketomethylene type couplers suited for use according to the present invention are the colour couplers forming a yellow azomethine dye with an oxidized primary amino p-phenylene diamine. Such couplers are described e.g. by P. Glafkidès in "Photographic Chemistry", Vol. II (1960) p.597-602 under the heading "yellow couplers" and in the United Kingdom Patent Specification Nos. 1,039,965, 1,075,084 and 1,062,203.

A particularly useful non-ring closed ketomethylene type coupler corresponds to the following structural formula:

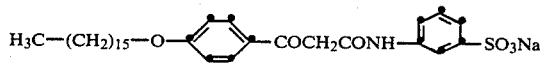

The above colour couplers (2) and hydrazone compounds (1) are preferably incorporated in the silver halide emulsion layer(s) of the photographic material. Preferably said couplers and hydrazones contain in their structure a so-called "ballasting group" making these compounds resistant to diffusion in hydrophilic photographic colloid layers. Such a group is preferably an aliphatic group containing at least 5 and preferably from 5 to 20 carbon atoms. The colour coupler may contain an ionic substituent such as a carboxylic acid or sulpho group enabling the incorporating of the couplers in dissolved form in an alkaline medium in the photographic emulsion which is then acidified later on.

The colour couplers and hydrazones used according to the present invention may be added to the light-sensitive silver halide composition in dissolved or finely dispersed state either or not with the aid of high-boiling solvents. Suitable techniques for the incorporation of photographic ingredients into colloid compositions are described e.g. in the published Dutch Patent Application Nos. 675,529, 675,531, 675,532, 675,530 and 675,528, in the Belgian Patent Specification No. 705,889, the United Kingdom Patent Specification No. 1,453,057, published European Patent Application No. 0027 284 and Research Disclosure 18815 of Dec. 1979 and 19529 of July 1980.

The amount of hydrazone and colour coupler in the silver halide material is not critical. Preferably, however, the colour coupler, the hydrazone and the silver halide are present in a ratio of 1 mole of colour coupler for at least one equivalent of hydrazone and at least 4 moles of silver halide. The coverage per sq.m. in the photographic material of the hydrazone compound (1) and coupler (2) is e.g. in the range of 1 to 2 mmole/sq.m.

According to a special embodiment the hydrazone compound and colour coupler are united in one compound $C_1$-$C_2$ in which the $C_1$ part is the colour coupler part and the $C_2$ part is the hydrazone part. When using such compound an "intramolecular" oxidative coupling takes place in the developing conditions of the present invention.

"Intramolecular" oxidative coupling means that the reactive $C_1$ and $C_2$ parts of the same $C_1$-$C_2$ molecule are oxidatively coupled and form a dye molecule.

In particularly suited $C_1$-$C_2$ compounds described in the published German Patent Application No. 2214 381 the part $C_1$ is a group containing the structure of an α-naphthol coupler and corresponds to the following general formula:

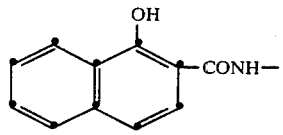

The $C_2$ part corresponds preferably to the following general structure:

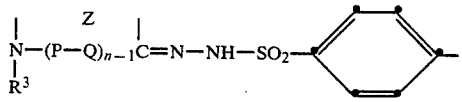

wherein:

P and Q (same or different) represent a methine group or a substituted methine group, $R^3$ represents an alkyl group or an aryl group, n is 1 or 2, and Z represents the necessary atoms to close a heterocyclic nitrogen-containing nucleus including said nucleus in substituted form, e.g. substituted with an alkyl and a sulpho group.

A preferred $C_1$-$C_2$ compound that produces an azino dyestuff by oxidative intramolecular coupling has the following formula:

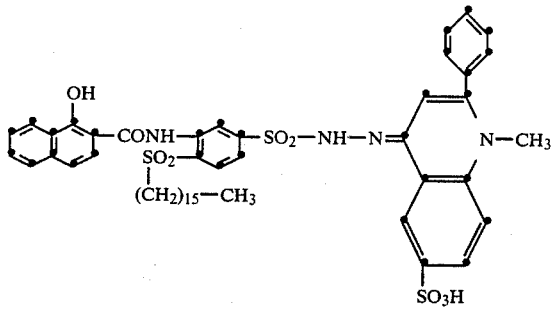

(melting point: 140° C.).

ETA-compounds (3) for use in the present photographic material are preferably p-phenylene diamines which are N,N and N',N'-substituted with alkyl groups and/or of which the N or N'-nitrogen atoms make part of a ring closed by an alkylene group. Preferably at least one of said alkyl groups is substituted with a substituent improving water or alkali-solubility e.g. a carboxyl, sulpho, sulphonamido or hydroxyl substituent.

For example ETA-compounds (3) for use in the present photographic material are within the scope of one of the following general formulae (I) or (II):

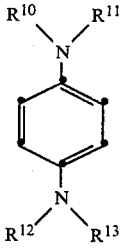

(I)

wherein:

each of $R^{10}$, $R^{11}$, $R^{12}$ and $R^{13}$ (same or different) represents an alkyl group or substituted alkyl group, preferably a lower ($C_1$–$C_5$) alkyl group e.g. substituted with hydroxyl or $R^{10}$ and $R^{11}$ and/or $R^{12}$ and $R^{13}$ together represent the necessary atoms e.g. alkylene group to close a 5- or 6-membered heterocyclic nitrogen-containing ring e.g. pyrrolidine ring or $R^{10}$ and/or $R^{11}$ and/or $R^{12}$ and/or $R^{13}$ represent the necessary atoms e.g. alkylene group to close via the orthocarbon atom of the benzene ring a 5- or 6-membered nitrogen-containing adjacent heterocyclic nucleus.

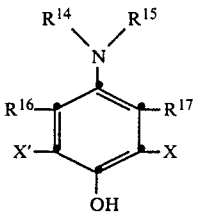

(II)

wherein: each of $R^{14}$ and $R^{15}$ (same or different) represents an alkyl group or substituted alkyl group, preferably a lower ($C_1$–$C_5$) alkyl group and each of $R^{16}$ and $R^{17}$ simultaneously represents hydrogen, or $R^{14}$ and $R^{15}$ together with the N atom to which they are joined constitute a pyrrolidine nucleus and each of $R^{16}$ and $R^{17}$ simultaneously represents a hydrogen atom, or $R^{14}$ represents a hydrogen atom, an alkyl radical or a substituted alkyl radical, and $R^{15}$ together with $R^{17}$ simultaneously represents an alkylene radical or a substituted alkylene radical to close a fused 5- or 6-membered nucleus, or $R^{14}$ and $R^{16}$ as well as $R^{15}$ and $R^{17}$ represents an alkylene radical to close a fused 5- or 6-membered nucleus;

each of X and X' (same or different) represents a hydrogen atom, a halogen atom, e.g. a chlorine atom, or an electron-donating group, e.g. an alkyl group, an alkoxy group, an amino group, a monoalkylamino group, a dialkyl amino group or an acylamino group wherein the acyl radical is derived from a carboxylic or sulphonic acid.

Specific compounds according to general formula (I) are described in the United Kingdom Patent Specification Nos. 989,383, 1,191,535 and 1,365,300 U.S. Pat. Nos. 3,265,502 and 3,615,525 and in Research Disclosure December 1981 item 21210 and in prior art references mentioned in these documents.

Specific compounds according to general formula (II) are described in the United Kingdom Patent Applications Nos. 928,671 and 1,003,783 and in the U.S. Pat. No. 3,265,499.

A particularly useful ETA-compound is N,N-diethyl, N',N'-di(β-hydroxyethyl)p-phenylene diamine.

Anti-oxidants (4) which fulfil the requirement of reducing a semiquinone derived from the electron transfer agent (3) are 1,2-enediols and are e.g. reductones characterized by the following structural group

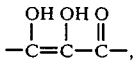

which group may be present in an acyclic or cyclic structure.

Typical examples of reducing 1,2-enediols and reductones are:

| | | |
|---|---|---|
| (a) | HOCH=COHCHO | (reductone) |
| (b) | 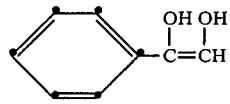 | (α,β-dihydroxyvinyl benzene) |
| (c) | 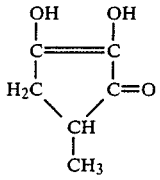 | (methyl reductic acid) |
| (d) | 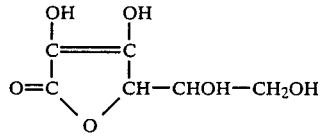 | (ascorbic acid) |

A preferred anti-oxidant (4) is ascorbic acid having at pH 2 a polarographic half-wave potential ($E_{\frac{1}{2}}$) 118 mV more negative (according to the European Convention) than the $E_{\frac{1}{2}}$ value of N,N-diethyl, N',N'-di(β-hydroxyethyl)p-phenylene diamine at the same pH value.

Although the ETA-compound (3) and anti-oxidant (4) may be applied in the silver halide emulsion layer(s) of the present photographic material it is preferable to incorporate these ingredients into a non-light-sensitive hydrophilic colloid layer in water-permeable relationship with the silver halide emulsion layer(s) e.g. into a protective outer layer from which these ingredients can reach the emulsion layer(s) when the photographic material is wetted with an aqueous alkaline liquid. With such a disposition of ingredients fogging and spectral desensitization are particularly well avoided. The pH of the coating composition from which the ingredients (3) and (4) are applied is preferably not higher than 5.

The coverage of ETA-compound (3) is preferably 2 to 3 mmole per sq.m, while the coverage of silver halide is preferably 12 to 15 mmole per sq.m. The anti-oxidant (4) is preferably present in the photographic material in an amount of 0.1 to 0.3 mmole per sq.m.

When the present photographic materials contain only one silver halide emulsion layer or a plurality of the same spectrally sensitive silver halide emulsion layers they are suited for the production of monochromic dye images in combination with a silver image that may be removed by a common bleaching technique.

When using a photographic material of the present invention incorporating a plurality of differently spectrally sensitive silver halide emulsions it is possible to produce therewith multicolour images. For obtaining a true multicolour reproduction the present photographic material contains (a) red-sensitive silver halide emulsion layer(s), a green-sensitive silver halide emulsion layer(s), and (a) only blue-sensitive silver halide emulsion layer(s), the red-sensitive silver halide emulsion layer(s) containing in non-migratory form a colour coupler capable of forming a cyan dye on development with a hydrazone compound of the type cited above, the green-sensitive silver halide emulsion layer(s) containing in non-migratory form a colour coupler capable of forming on development a magenta dye with a said hydrazone compound, the only blue-sensitive silver halide emulsion layer(s) containing in non-migratory form a colour coupler capable of forming a yellow dye with a said hydrazone compound.

In the multilayer photographic colour material a yellow filter layer may be present between the blue-sensitive emulsion layer and the green or red-sensitive silver halide emulsion layer.

In the production of monochromic dye images the silver image does not need to be removed since it may be advantageous e.g. in the production of masks in the graphic art field or in radiography to obtain images with an optical density as high as possible with a silver content as low as possible. Thus the combination of a dye and silver image provides economies in the use of silver. The information contained in the monochromic dye image even in the presence of the silver image offers a better image detail retrieval e.g. in radiographs as has been described e.g. in U.S. Pat. Nos. 3,734,735 and 4,059,454. The present invention is therefore of particular interest for the production by radiography of monochromic images derived from the dye plus silver.

In monochromic silver and dye image reproduction a mixture of properly selected hydrazone compounds and/or of colour couplers may yield practically neutral black dye images. In monochromic X-ray colour radiographs preference is given to a blue dye image having its main absorption in the red region (600–700 nm) of the visible spectrum and a side absorption in the green region (500–600 nm) of the visible spectrum for at least 30% in respect of the red region.

The silver halide in the emulsion layer(s) may comprise varying amounts of silver chloride, silver iodide, silver bromide, silver chlorobromide or silver bromoiodide. Particularly good results are obtained in monochrome medical X-ray materials with silver bromoiodide emulsions in which the average grain size of the silver bromoiodide crystals is in the range of about 0.1 to about 3 μm.

In medical X-ray radiography a duplitized silver halide emulsion layer material is commonly employed. When producing a combined dye and silver image the total silver halide coverage per unit area (sq.dm) for both emulsion layers corresponds preferably to less than about 0.080 g of silver and each such emulsion layer contains then less than about 0.040 g of silver per sq.dm. As these layers are applied by means well-known in the art, it is desirable in the radiographic materials of the present invention that the silver halide emulsion layers and other coatings at one side of the support be capable of transmitting less than about 40% and preferably less than about 30% of the incident radiation from the X-ray intensifying screens used in the X-ray exposure.

The proper transmittance can be obtained in a variety of ways, such as e.g. by the incorporation of optically separating barriers, e.g. undercoats, which can be positioned between the silver halide-containing layers, by altering the composition of such layers, by including dyes or other materials, by adjusting the halide balance or by modifying the silver halide grain shape, grain size and size distribution.

Negative-type silver halide emulsions are normally used but likewise direct-positive emulsions may be used such as those described e.g. in German Patent Specification No. 1,169,290 and U.S. Pat. No. 3,367,778 of Robert W. Berriman, issued Feb. 6, 1968 relating to silver halide emulsion containing silver halide grains mainly sensitive in the core.

The image-forming silver halide emulsion may be chemically sensitized by any of the known procedures. The emulsions may be digested with naturally active gelatin or with small amounts of sulphur-containing compounds such as allyl thiocyanate, allylthiourea, sodium thiosulphate, etc. The image-forming emulsion may be sensitized likewise by means of reductors, e.g. tin compounds as described in the United Kingdom Pat. No. 789,823 filed Apr. 29, 1955 by Gevaert Photo-Producten N.V., polyamines e.g. diethyltriamine, and small amounts of noble metal compounds such as gold platinum, palladium, iridium, ruthenium and rhodium as described by R. Koslowsky, Z. Wiss. Phot. 46, 67–72 (1951). Representative examples of noble metal compounds are ammonium chloropalladate, potassium chloroplatinate, potassium chloroaurate and potassium aurithiocyanate.

Emulsion stabilizers and antifoggants may be added to the silver halide emulsion e.g., the known sulphinic and selenic acids or salts thereof, aliphatic, aromatic or heterocyclic mercapto compounds or disulphides, e.g. those described and claimed in published German Patent Application No. 2,100,622 filed Jan. 8, 1971 by Agfa-Gevaert A.G., preferably comprising sulpho groups or carboxyl groups, mercury compounds e.g. those described in Belgian Pat. Nos. 524,121 filed Nov. 7, 1953 by Kodak Ltd., 677,337 filed Mar. 4, 1966 by Gevaert-Agfa N.V., 707,386 filed Dec. 1, 1967 by Gevaert-Agfa N.V. and 709,195 filed Jan. 11, 1968 by Gevaert-Agfa N.V., and tetra-azaindenes as described by Birr in Z.Wiss.Phot. 47, 2–58 (1952), e.g. the hydroxy-tetra-azaindenes of the following general formula:

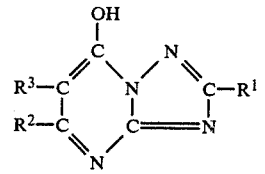

wherein:

each of $R^1$ and $R^2$ represents hydrogen, an alkyl, an aralkyl, or an aryl group, and $R^3$ represents hydrogen, an alkyl, a carboxy, or an alkoxycarbonyl group, such as 5-methyl-7-hydroxy-s-triazolo[1,5-a]-pyrimidine.

Other additives may be present in one or more of the hydrophilic colloid layers of the radiation-sensitive silver halide elements of the present invention, e.g. hardening agents such as formaldehyde, dialdehydes, hydroxyaldehydes, mucochloric and mucobromic acid, acrolein, and glyoxal, mordanting agents for anionic colour couplers or dyes formed therefrom, plasticizers and coating aids e.g. saponin, e.g. dialkylsulphosuccinic acid salts such as sodium diisooctyl sulphosuccinate, alkylarylpolyether sulphuric acids, alkylaryl polyether sulphonic acids, carboxy alkylated polyethylene glycol ethers or esters as described in French Pat. No. 1,537,417 filed Sept. 18, 1967 by Agfa-Gevaert N.V. such as iso—$C_8H_{17}$—$C_6H_4(OCH_2CH_2)_8$—$OCH_2COONa$, fluorinated surfactants, e.g., those described in Belgian Pat. No. 742,680 filed Dec. 5, 1969 by Agfa-Gevaert N.V. and the published German Patent Applications Nos. 1,950,121 filed Oct. 4, 1969 by Dupont de Nemours and 1,942,665 filed Aug. 21, 1969 by Ciba A.G., inert particles such as silicon dioxide, glass, starch and polymethacrylate particles.

The silver halide emulsion layers used in the invention comprise the photosensitive silver halide dispersed preferably in gelatin and are about 0.2 to 2 μm thick; the ETA-compound (3) and anti-oxidant (4) are included preferably in a polymeric binder permeable to alkaline solutions, such as gelatin, to form a separate layer of about 1 to 7 μm thick, in water permeable relationship with the emulsion layer(s). Of course, these thicknesses are approximately only and may be modified according to the product desired.

More details about composition, preparation and coating of photographic silver halide emulsions are described, e.g., in Product Licensing Index, Vol. 92, December 1971, publication 9232, p. 107–109.

The support for the photographic elements of this invention may be any material as long as it does not deleteriously affect the photographic properties of the material and is dimensionally stable. Typical flexible sheet materials are paper supports, e.g. coated at one or both sides with an α-olefin polymer, e.g. polyethylene; other examples include cellulose nitrate film, cellulose acetate film, poly(vinyl acetal) film, polystyrene film, poly(ethylene terephthalate) film, polycarbonate film, polyα-olefins such as polyethylene and polypropylene film, and related films or resinous materials. The support is usually about 0.05 to 0.15 mm thick.

In medical radiography it is important that the time required to obtain access to the recorded information be as short as possible. Therefore the exposed radiographic silver halide materials should have a composition that they can be processed in a minimum of time, e.g. at elevated temperature (above 30° C.) as described e.g. in U.S. Pat. No. 3,820,991.

The alkaline processing composition employed in the development of the photographic material of this invention can be a simple aqueous solution of an alkaline substance, e.g. sodium hydroxide, sodium or potassium carbonate or an amine such as diethylamine, preferably used in an amount providing a pH beyond 11.

The solution may contain a viscosity-increasing compound such as a high-molecular-weight polymer, e.g. a water-soluble ether inert to alkaline solutions such as hydroxyethylcellulose or alkali metal salts of carboxymethylcellulose such as sodium carboxymethylcellulose. A concentration of viscosity-increasing compound to impart to the processing composition a viscosity of about 100 mPa.s to about 200.000 mPa.s is preferred.

Processing may proceed in a tray developing unit as is present, e.g. in an ordinary silver complex diffusion transfer reversal (DTR) apparatus in which the contacting with a separate dye image-receiving material is effected after a sufficient absorption of processing liquid by the photographic material has taken place. A suitable apparatus for this purpose is the COPYPROOF CP 38 (trade name) DTR-developing apparatus. COPYPROOF is a trade name of Agfa-Gevaert N.V. Mortsel/Belgium.

According to another embodiment the processing liquid is applied from a rupturable container or by spraying. In general the rupturable container comprises a rectangular sheet of fluid and air-impervious material folded longitudinally upon itself to form two walls that are sealed to one another along their longitudinal and end margins to form a cavity in which processing solution is contained.

The following examples illustrate the present invention without, however, limiting it thereto. All ratios and percentages are by weight unless otherwise indicated.

COMPARATIVE EXAMPLE 1

Material A 1.2 g (2 mmole) of the hydrazone compound no. 1 of Table 1 dispersed in a pearl-mill in admixture with water, a surfactant and 1 g of gelatin were added to a silver chloride-bromide-iodide (48/50/2) emulsion corresponding with a silver halide content equivalent with 2 g of silver nitrate. To the obtained mixture 2 mmole of the latex colour coupler A having the structure described hereinafter and 4 g of gelatin were added, whereupon the whole composition was coated to cover 1 sq.m of a subbed polyethylene terephthalate support.

Onto the dried silver halide emulsion layer a protective coating was applied containing 1.5 g of gelatin per sq.m and the necessary spreading and hardening agents. The photographic material yielded by the defined test A a pH in the range of 2 to 5.

Material B

Material B has the same composition as material A with the difference, however, that 0.6 g of N,N-diethyl, N',N'-di(β-hydroxyethyl)p-phenylene diamine (ETA-compound A) was added to the protective layer composition.

Material C

Material C has the same composition as material B with the difference, however, that with respect to the ETA-compound 5% of ascorbic acid was added to the protective layer composition resulting in 30 mg of ascorbic acid per sq.m.

COMPARATIVE TEST PROCEDURE

Test 1

Material A was exposed through a grey wedge with constant 0.15 and developed for 30 s at 40° C. in an aqueous processing composition containing per liter:

| | |
|---|---|
| $K_2CO_3$ | 65 g |
| KBr | 1.5 g |
| $Na_2CO_3$ | 5 g |
| ethylene diamine tetraacetic acid sodium salt | 2 g |
| ETA-compound A | 5 g |

Test 2

Material B was exposed and processed as material A with the difference, however, that the ETA-compound A was left out of the processing composition.

Test 3

Material C was exposed and processed as material B.

Sensitometric results

The sensitometric results in the form of density (D) versus relative log E curves A, B and C of the wedge images obtained in the materials A, B and C by tests 1, 2 and 3 respectively are illustrated in the accompanying FIG. 1. Herefrom may be concluded that:

(1) the sensitivity of material C according to the present invention processed with the activator bath has reached the level of the sensitivity of material A processed with the developing bath containing said ETA compound A;

(2) the fog value of material C is lower than the fog value of material A and is of practically the same level as the fog value of material B;

(3) the maximum density of material C surpasses the maximum density of material A.

(4) the sensitivity of material C is markedly higher than the sensitivity of material B.

Structure of latex-colour coupler A

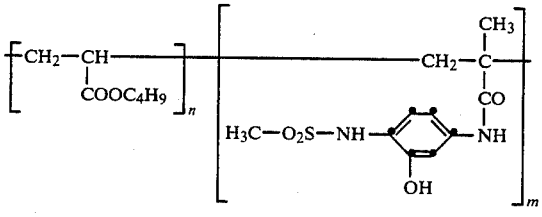

(prepared as described for the colour couplers according to the United Kingdom Patent Specification No. 1,363,230).

COMPARATIVE EXAMPLE 2

Material D

The preparation of Material B of Example 1 was repeated with the difference, however, that the ETA-compound A was replaced by 0.3 g of 4-pyrrolidinophenol (ETA-compound B).

Material E

The preparation of Material D was repeated but the ETA-compound B was used in admixture with 20 mg of ascorbic acid.

The comparative test procedure using Materials D and E proceeded as described in Example 1 with the aqueous processing composition wherefrom the ETA-compound A was omitted.

Sensitometric results

The sensitometric results in the form of density (D) versus relative log E curves D and E of the wedge images obtained in the materials D and E respectively are illustrated in the accompanying FIG. 2 clearly demonstrating the improvement obtained with Material E according to the present invention.

We claim:

1. A photographic material suited for the production of at least one azine dye image, comprising (a) at least one silver halide emulsion layer or (b) at least one silver halide emulsion layer and at least one non-light-sensitive hydrophilic colloid layer in water-permeable relationship with such an emulsion layer, which contains in at least one such layer:

(1) a heterocyclic hydrazone compound, (2) a phenol, naphthol or active methylene coupler compound capable of forming an oxidative coupling with compound (1) an azine dye, and (3) a developing agent which is an electron transfer agent capable of forming a positively charged semiquinone on oxidation with exposed silver halide, (4) an anti-oxidant which is a reducing agent capable of reducing said semiquinone in acidic medium, and having in the pH range of 2–5 a polarographic half-wave potential (E ½) determined according to the European Convention which is at least 40 mV more negative than the polarographic half-wave potential of the ETA-compound in the same pH range, and (5) a sufficient amount of an acidic medium for said anti-oxidant that when 1 sq.dm. of said material is immersed in 100 ml. of distilled water for 30 min. said water exhibits an acid pH lower than pH 7.

2. Photographic material according to claim 1, wherein said heterocyclic hydrazone compound corresponds to the following general formula:

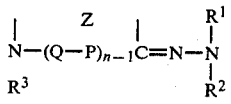

wherein:

n is 1, 2, or 3, $R^1$ is hydrogen or an acyl group, $R^2$ is a $—CONH_2$ group or a $—SO_2X$ group, wherein X represents a hydroxyl group, an amino group, a hydrocarbon group, an acyl group, or a heterocyclic group, $R^3$ is an alkyl group or an aryl group, P and Q, the same or different, represent a methine group, and Z represents the necessary atoms to close a nitrogen-containing heterocyclic nucleus including said nucleus in substituted form.

3. Photographic material according to claim 1, wherein said heterocyclic hydrazone compound corresponds to one of the following general formulae:

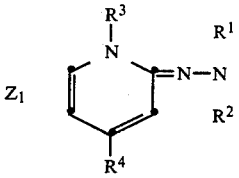

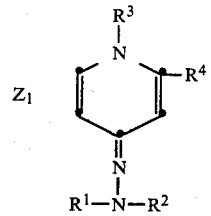

wherein:

$R^1$ is hydrogen or an acyl group, $R^2$ is a $—CONH_2$ group or a $—SO_2X$ group, wherein X represents a hydroxyl group, an amino group, an aliphatic hydrocarbon group, an aryl group, or a heterocyclic group, $R^3$ is an alkyl group or an aryl group;

$R^4$ is an alkyl group or an aryl group, and $Z^1$ represents the atoms necessary to complete a benzene nucleus.

4. Photographic material according to claim 1, wherein said compound (2) capable of forming on oxidative coupling with compound (1) an azine dye is a phenol compound corresponding to the following general formula:

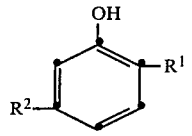

each of $R^1$ and $R^2$ represents hydrogen, an alkyl group an alkoxy group, or the group —NHR in which R represents a carboxylic acid acyl or sulphonic acid acyl group, with the proviso that $R^1$ and $R^2$ do not represent hydrogen at the same time.

5. Photographic material according to claim 1, where said ETA-compound (3) is a p-phenylene diamine compound which is N,N and N',N'-substituted with alkyl groups and/or of which the N- or N'-nitrogen atoms make part of a ring closed by an alkylene group.

6. Photographic material according to claim 5, wherein at least one of said alkyl groups is substituted with a substituent selected from the group consisting of carboxyl, sulpho, sulphonamido or hydroxyl.

7. Photographic material according to claim 1, wherein said ETA-compound is within the scope of one of the following general formulae:

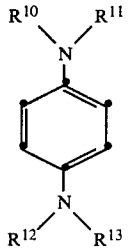

(I)

wherein:

each of $R^{10}$, $R^{11}$, $R^{12}$ and $R^{13}$, the same or different, represents an alkyl group, or $R^{10}$ and $R^{11}$ or $R^{12}$ and $R^{13}$ represent the necessary atoms to close a 5- or 6-membered heterocyclic nitrogen-containing ring or one or both of $R^{10}$ and/or $R^{11}$ represent the necessary atoms to close via the nearest ortho-carbon atom of the benzene ring a 5- or 6-membered nitrogen-containing adjacent heterocyclic nucleus;

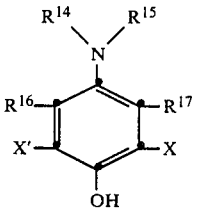

(II)

wherein:

each of $R^{14}$ and $R^{15}$, the same or different, represents an alkyl group, and each of $R^{16}$ and $R^{17}$ simultaneously represents hydrogen, or $R^{14}$ and $R^{15}$ together with the N atom to which they are joined constitute a pyrrolidine nucleus and each of $R^{16}$ and $R^{17}$ simultaneously represents a hydrogen atom, or $R^{14}$ represents a hydrogen atom, an alkyl radical, alkyl radical, and $R^{15}$ together with $R^{17}$ simultaneously represents an alkylene radical to close a fused 5- or 6-membered nucleus, or $R^{14}$ and $R^{16}$ as well as $R^{15}$ and $R^{17}$ represents an alkylene radical to close a fused 5- or 6-membered nucleus;

each of X and X', the same or different, represents a hydrogen atom, a halogen atom, or an electron-donating group, or an acylamino group wherein the acyl radical is derived from a carboxylic or sulphonic acid.

8. Photographic material according to claim 6, wherein said ETA-compound is N,N-diethyl, N',N'-di(β-hydroxyethyl)p-phenylene diamine.

9. Photographic material according to claim 1, wherein said reducing agent (4) is a 1,2-enediol.

10. Photographic material according to claim 9, wherein said 1,2-enediol is ascorbic acid.

11. Photographic material according to claim 1, wherein the ETA-compound (3) and anti-oxidant (4) are incorporated into a non-light-sensitive hydrophilic colloid layer in water-permeable relationship to said silver halide emulsion layer.

12. Photographic material according to claim 1, wherein the thus-formed azine dye has a main absorption in the red region (600–700 nm) of the visible spectrum and a side absorption in the green region (500–600 nm) for at least 30% in respect of the red region.

13. A method for producing at least one coloured image characterized in that an image-wise photo-exposed photographic material suited for the production of at least one azine dye image, comprising (a) at least one silver halide emulsion layer (b) at least one silver halide emulsion layer and at least one a non-light-sensitive hydrophilic colloid layer in water-permeable relationship with such an emulsion layer, which contains in at least one such layer:

(1) a heterocyclic hydrazone compound, (2) a phenol, naphthol or active methylene coupler compound capable of forming an oxidative coupling with compound (1) an azine dye, (3) a developing agent which is an electron transfer agent capable of forming a positively charged semiquinone on oxidation with exposed silver halide, (4) An anti-oxidant which is a reducing agent capable of reducing said semiquinone in acidic medium, and having in the pH range of 2–5 a polarographic half-wave potential ($E\ \frac{1}{2}$) determined according to the European Convention is at least 40 mV more negative than the polargraphic half-wave potential of the ETA-compound in the same pH range, and (5) a sufficient amount of an acidic medium for said anti-oxidant that a 1 sq.dm. sample of said material when immersed in distilled water for 30 min. exhibits an acid pH less than pH 7, is treated with an alkaline aqueous solution to produce such azine dye image.

* * * * *

UNITED STATES PATENT AND TRADEMARK OFFICE

CERTIFICATE OF CORRECTION

PATENT NO. : 4,514,494

DATED : April 30, 1985

INVENTOR(S) : RAYMOND G. LEMAHIEU et al

It is certified that error appears in the above-identified patent and that said Letters Patent is hereby corrected as shown below:

column 3, between lines 18 and 25, and in Claim 2, in the structural formula of each, the dotted lines to incorporate the substituent Z need to be added as follows:

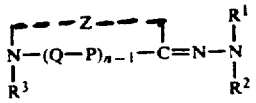

column 3, between lines 45 and 64, and in Claim 3, in the structural formula of each, the dotted lines to incorporate the substituent $Z_1$ need to be added as follows:

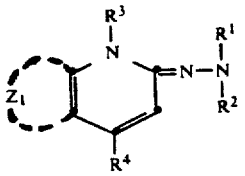

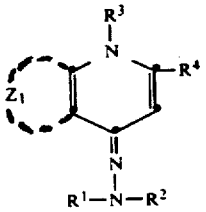

UNITED STATES PATENT AND TRADEMARK OFFICE

CERTIFICATE OF CORRECTION

PATENT NO. : 4,514,494

DATED : April 30, 1985

INVENTOR(S) : RAYMOND G. LEMAHIEU et al

It is certified that error appears in the above-identified patent and that said Letters Patent is hereby corrected as shown below:

In Claim 13, line 22, after "European Convention"

--- which --- needs to be inserted.

Signed and Sealed this

*Twentieth* Day of *August 1985*

[SEAL]

*Attest:*

DONALD J. QUIGG

*Attesting Officer*

*Acting Commissioner of Patents and Trademarks*